US006154122A

United States Patent [19]

Menze

[11] Patent Number: 6,154,122

[45] Date of Patent: Nov. 28, 2000

[54] SNOWPLOW DIAGNOSTIC SYSTEM

[75] Inventor: Peter C. Menze, Marquette, Mich.

[73] Assignee: M. P. Menze Research & Development, Marquette, Mich.

[21] Appl. No.: 09/240,463

[22] Filed: Jan. 29, 1999

[51] Int. Cl.[7] ..... B60Q 1/00

[52] U.S. Cl. ..... 340/425.5; 340/438; 340/644; 340/654; 362/487; 701/29

[58] Field of Search ..... 340/425.5, 438, 340/644, 654; 362/487; 701/29; 37/234, 236

[56] References Cited

U.S. PATENT DOCUMENTS

| | | | |
|---|---|---|---|
| 2,427,076 | 9/1947 | Tabacchi | 315/83 |
| 2,843,802 | 7/1958 | Brohl | 315/83 |
| 3,250,950 | 5/1966 | Reiche | 315/77 |
| 3,369,147 | 2/1968 | Ramsey | 315/83 |
| 3,671,955 | 6/1972 | Malekzadeh | 340/251 |
| 3,673,456 | 6/1972 | Sonius | 315/83 |
| 3,728,705 | 4/1973 | Atkins | 340/251 |
| 3,733,515 | 5/1973 | Parkes | 315/83 |
| 3,814,984 | 6/1974 | Morita et al. | 315/83 |
| 3,952,209 | 4/1976 | Shaklee et al. | 307/9 |
| 3,956,733 | 5/1976 | Sakurai | 340/79 |
| 4,017,772 | 4/1977 | Burnside | 361/428 |
| 4,051,383 | 9/1977 | Dola | 307/11 |
| 4,055,831 | 10/1977 | Sakurai et al. | 340/81 R |
| 4,190,830 | 2/1980 | Bell | 340/642 |
| 4,195,281 | 3/1980 | Bell | 340/79 |
| 4,246,566 | 1/1981 | Endo et al. | 340/52 F |
| 4,280,062 | 7/1981 | Miller et al. | 307/10 LS |
| 4,550,303 | 10/1985 | Steele | 340/80 |
| 4,667,187 | 5/1987 | Volk et al. | 340/641 |
| 4,675,560 | 6/1987 | Stroppiana | 307/570 |
| 4,727,261 | 2/1988 | Fairchild | 307/10 LS |
| 4,734,625 | 3/1988 | Geanous et al. | 315/313 |
| 4,745,339 | 5/1988 | Izawa et al. | 315/130 |
| 4,807,375 | 2/1989 | Iraci | 37/236 |
| 4,808,975 | 2/1989 | Hcohhaus et al. | 340/641 |
| 4,999,935 | 3/1991 | Simi et al. | 37/236 |
| 5,057,814 | 10/1991 | Onan et al. | 340/458 |
| 5,124,616 | 6/1992 | Wrzesinski | 323/284 |
| 5,136,280 | 8/1992 | Heggli | 340/664 |
| 5,361,519 | 11/1994 | Ciula et al. | 37/234 |
| 5,515,028 | 5/1996 | Dittmar | 340/458 |
| 5,574,423 | 11/1996 | Vosika et al. | 340/333 |
| 5,579,227 | 11/1996 | Simmons, Jr. et al. | 364/424.03 |
| 5,596,233 | 1/1997 | Leiber et al. | 307/9.1 |
| 5,619,182 | 4/1997 | Robb | 340/479 |
| 5,638,617 | 6/1997 | Belanger et al. | 37/270 |
| 5,691,692 | 11/1997 | Herbstritt | 340/438 |
| 5,720,122 | 2/1998 | McLellan | 37/233 |
| 5,760,490 | 6/1998 | Yanase | 307/10.8 |
| 5,760,545 | 6/1998 | Mikel | 315/77 |
| 5,832,637 | 11/1998 | Aguado et al. | 37/234 |

*Primary Examiner*—Jeffery A. Hofsass
*Assistant Examiner*—Tai T. Nguyen
*Attorney, Agent, or Firm*—Daniel G. Chapik; Craig J. Lervick; Oppenheimer Wolff & Donnelly LLP

[57] ABSTRACT

The present invention is a snowplow diagnostic and connection system for connecting a snowplow to a vehicle. The system includes an diagnostic circuit and an indicator which detects and indicates the status of various components of the snowplow and its controls. The indicator includes a specific indication of the status of each detected subsystem or each component, as well as providing a general warning if any problem is detected. The indicator has a plurality of LED's which individually represent the various subsystems or components. If a problem is detected with any of the subsystems or components, the vehicle's headlights are caused to flash, thus alerting the operator.

23 Claims, 5 Drawing Sheets

SNOWPLOW DIAGNOSTIC SYSTEM

BACKGROUND OF THE INVENTION

The present invention relates generally to snowplow systems and more particularly to a self diagnosing snowplow connecting system for connecting a snowplow or other accessory to a vehicle.

One of the most common ways to move and remove fallen snow is with a snowplow attached to a vehicle. Generally, however, most vehicles are not dedicated to this single purpose. That is, during the milder seasons the snowplow is removed and the vehicle will be used for other purposes. To facilitate this, the vehicle will usually have a mounting bracket affixed to its frame. The snowplow can then be attached and removed as desired.

In addition, the snowplow must be connected to the vehicle's electrical system, both to receive power and to provide the proper controls to the operator. As such, a wiring harness consisting of an electrical connector and receptacle, is provided for connection between the vehicle and the snowplow. Once the snowplow is connected to the mounting bracket, the wiring harness is connected between the plow and the vehicle. The operator may then control the plow from within the cab of the vehicle.

Generally, a snowplow will have various electrical and mechanical components which must receive power from the vehicle and must also be controllable from inside the vehicle. For example, most snowplows will have hydraulic actuators which cause the plow to move up, down, right, left, and vary the angle at which the blade contacts the ground. In V blade plows, the angle between the two sections of the blade must also be controllable. Additionally, the snowplow will have its own set of lights. This is necessary because the blade of the plow will often obstruct the vehicle's integrated headlights. Without the additional lighting, the snowplow could not be used at night, which is often the snowplow operator's busiest period. As a result, the snowplow operator relies heavily on this lighting system. Therefore, it is of paramount importance that this lighting system be reliable and functional.

In many cases, the connection of the snowplow reconfigures the vehicles wiring. That is, once the snowplow is connected, the vehicles headlights are prevented from working at all, thus causing total reliance on the plow's lighting system. This is done to prevent the vehicle headlights from shining on and reflecting off of the back of the blade, which would distract the operator. To allow proper operation of the lights, the connection of the plow must alter the vehicle's internal wiring scheme. This is in addition to the power and control connections which are also necessary. Therefore, the wiring harness is more complicated than a simple power coupling.

A typical wire harness is shown in U.S. Pat. No. 4,280,062, issued to Miller et al. on Jul. 21, 1981. An auxiliary set of lights are provided and are connected to the vehicle's lighting controls. The harness is installed within the vehicle and provides a plug in for the auxiliary lighting system which may be selectively coupled to it. A switch allows the operator to select between the vehicle lighting system or the auxiliary lighting system. During installation, the vehicle lights are disconnected from the vehicle's wiring system. The connection to the wiring system is essentially split, through a Y connection that is coupled to a switch. The vehicle's headlights are then reconnected to one branch, while the auxiliary lighting system is coupled to the other branch of the wiring system. The switch then allows the operator to toggle between lighting systems.

Due to the complicated functionality that is required, the wiring harness has many potential weaknesses. The harness or any of its connections could fail due to the harsh, wet conditions as well as the sheer force generated during the plowing operation. Furthermore, the harness could simply be improperly coupled to the vehicle, due to operator error or an accumulation of snow or ice in the sockets. If for any reason, the plow is coupled incorrectly, the operator may not realize it, until the desired function becomes critical. Therefore a need exists to provide a snowplow connection system which checks the status of the connection and the plow components used, and indicates their readiness to the plow operator.

SUMMARY OF THE INVENTION

The present invention is a system that provides a connection between the plow and its controls/power supply and also includes a self diagnostic feature. A diagnostic circuit is included in the system and is coupled to a diagnostic indicator. The diagnostic indicator alerts the operator if any malfunction has occurred. The diagnostic circuit is coupled to the wire harness, and determines whether all of the connections have been properly made and whether each function is properly working. If a failure occurs, a general warning is generated. That is, the vehicle headlights may be caused to flash, or simply remain on. This alerts the operator of a problem. The diagnostic indicator also has a control panel. The panel will have more specific information relating the problem that was detected. For example, the control panel could have a series of LED's which indicate the status of each subsystem. At this point, the operator can take the appropriate steps to remedy the problem.

For example, if the system detects that the one of the snowplow's hydraulic controllers is inoperable, the vehicle's integrated headlights will be caused to flash. This generally indicates a malfunction at which point the operator will check the diagnostic indicator. The diagnostic indicator will show that the snowplow hydraulic controller is malfunctioning. The complexity of the indicator can vary. That is, a simple indicator might indicate a problem with the snowplow hydraulic subsystem, whereas a more complicated indicator will reference the hydraulic systems and the specific lighting elements and specifically indicate which system is malfunctioning. In either case, the operator has been made aware of the lighting problem. The operator may be able to replace the particular element, thus remedying the problem. If a more complex problem occurs, such as a complete failure of one or more of the hydraulic actuators, the operator may have to bring the plow in for servicing.

As mentioned above, the snowplow is electrically coupled to the vehicle with a wiring harness. The diagnostic indicator must be electrically coupled with the harness, however its physical location may vary. The diagnostic indicator could actually be incorporated into the wire harness itself, either on the snowplow or vehicle side. This provides an advantage in that each time the snowplow is connected, the operator can quickly check the status of the connection. Alternatively, the indicator could be mounted within the vehicle itself, either under the hood, in the cab, or in any convenient location. This would serve to protect the indicator from the elements when mounted in the cab. Also, the plow operator would have a convenient view each time the plow is used rather than just when it is being connected.

The snowplow connection system of the present invention must include a certain amount of diagnostic circuitry. For example, a plurality of continuity detectors can be used to monitor the hydraulic subsystems. This circuitry may also be located wherever it is most convenient. It is anticipated that this circuitry would be included within the housing of the diagnostic indicator, thus reducing the complexity of the installation. However, it may be advantageous to separate the diagnostic circuitry from the indicator in order to minimize the size of the indicator, especially if the indicator will be mounted within the cab of a the vehicle.

DETAILED DESCRIPTION OF PREFERRED EMBODIMENTS

Figure 1:
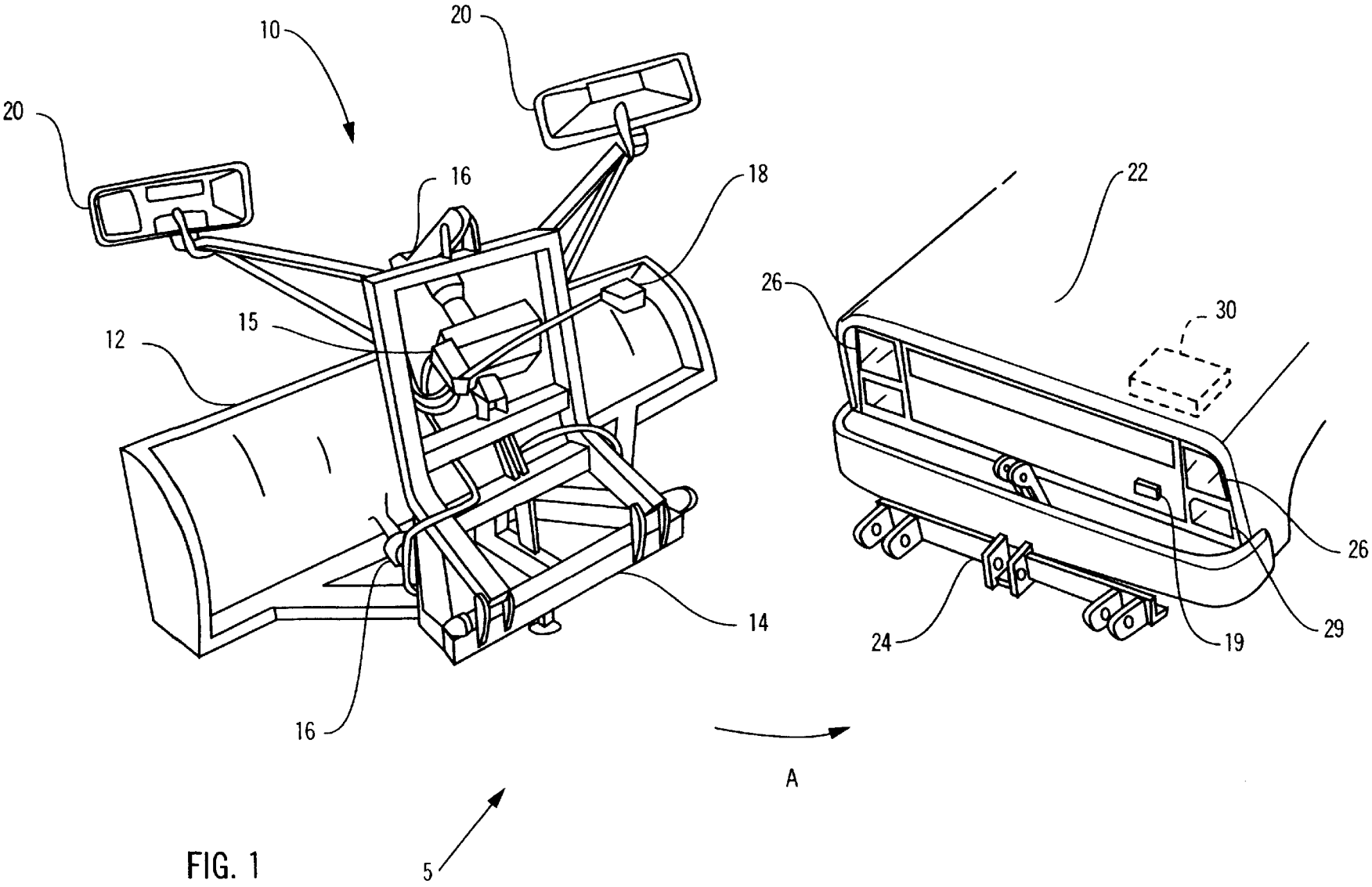
FIG. 1 is a perspective view of a snowplow and vehicle.

Turning to FIG. 1, the snowplow connection and diagnostic system of the present invention will be described. A snowplow 10 has a blade 12 coupled to a mounting frame 14. The blade 12 is moveable with respect to the mounting frame 14 by utilizing a series of hydraulic actuators 16 (two of which are shown). The hydraulic actuators 16 will cause the blade 12 to pivot to the right or left and move up or down. Other types of plows include a hinged center section, thereby forming a V in the blade 12. The angle of the blades would also be alterable with hydraulic actuators 16. In addition, some plows allow for the angle at which the plow meets the ground to be varied. A control box 15 is connected to the mounting frame 14. The control box 15 contains the various electrical components necessary to operate the plow 10, such as fuses and solenoids 46 (see FIG. 3) used to engage the hydraulic actuators 16.

Attached to the top of the mounting frame 14 are a pair of snowplow headlamps 20. These headlamps 20 will replace the function of the vehicle headlights 26. The snowplow headlamps 20 have low and high beams as well as integrated turn signals.

The snowplow 10 is connected to a vehicle 22, as shown by the arrow A, by securely coupling the snowplow mounting frame 14 to the vehicle mounting bracket 24. Then a wiring connector 18 is coupled to a receptacle 19 in the vehicle 22. This configuration could be altered in a variety of known ways. That is, the vehicle receptacle 19 could be temporarily or permanently affixed to the vehicle, either as a receptacle (as shown) or as a hanging wire having a receptacle at one end. In any event, the snowplow 10 must be electrically coupled to the vehicle 22. The wire connector 18 is coupled to the control box 15 of the plow. Thus attaching connector 18 connects the electrical system of the vehicle 22 to the headlamps 20 and solenoids 16.

The electrical coupling of the vehicle 22 to the snowplow 10, through wire connector 18 allows the operator to control the snowplow 10 from inside the cab of vehicle 22. While a variety of control configurations are possible, the vehicle's integrated headlights 26 are usually disabled when the snowplow 10 is connected. The vehicle's lighting controls will then serve to control the snowplow's headlamps 20. This function is automatically carried out by the circuitry of the present invention. Alternatively, separate controls could be provided for each set of lights, allowing the operator to choose.

An additional plow control unit is provided within the cab. This plow control unit could be a joystick or a plurality of switches, mounted to a control box or directly to the dash. The additional control allows the operator to initiate and control the movement of the snowplow 10 via the various hydraulic actuators 16.

Figure 2:
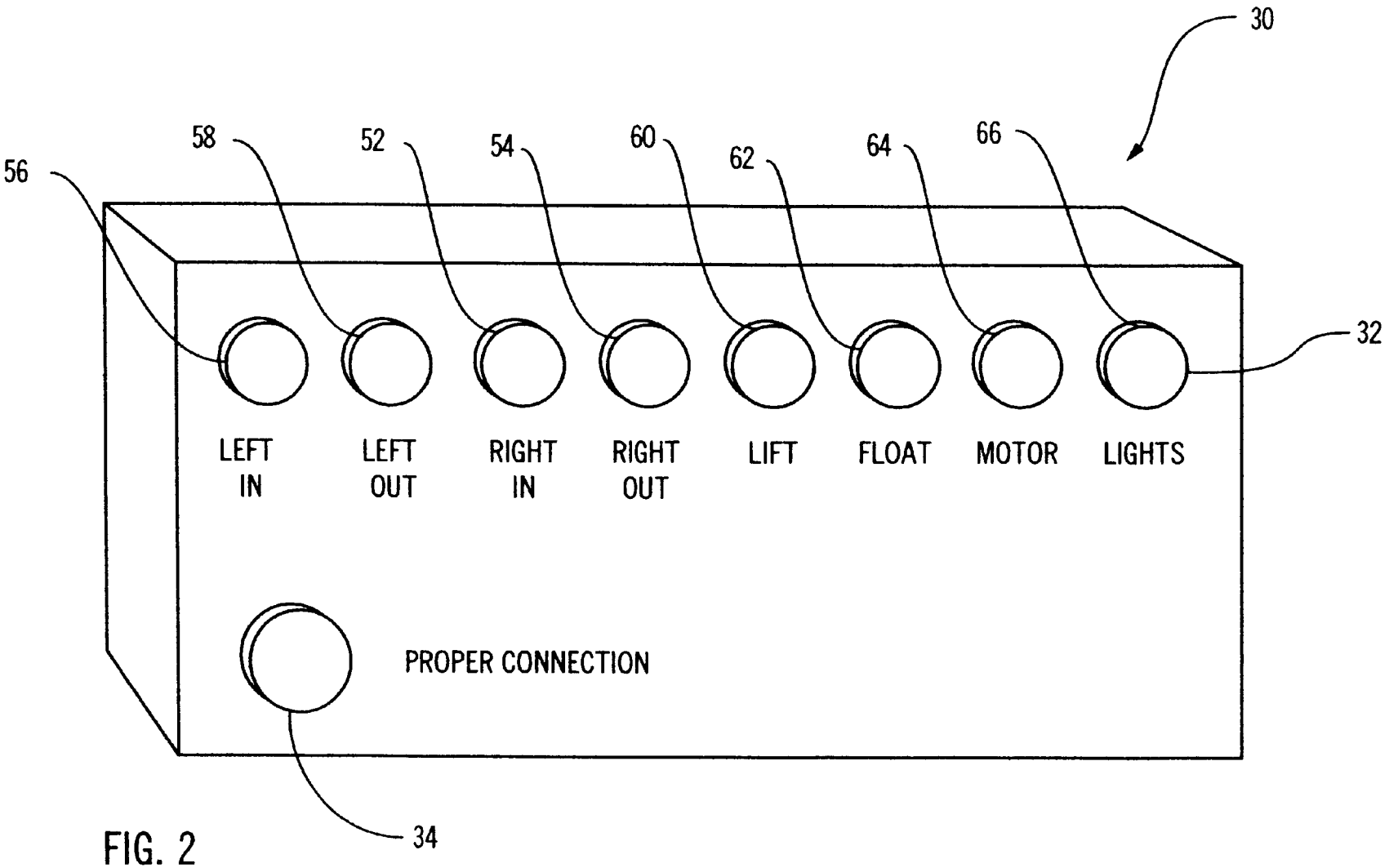
FIG. 2 is a perspective view of a diagnostic indicator.

Turning to FIG. 2, the snowplow connection system also includes a diagnostic indicator 30. The diagnostic indicator 30 is positioned so that it is electrically coupled between the snowplow 10 and the vehicle 22. The diagnostic indicator 30 could be positioned between the wire connector 18 and receptacle 19, mounted to either mounting frame 14,24, placed under the hood of the vehicle 22, placed within the cab of the vehicle 22, or located in any other convenient position. For example, in FIG. 1, the diagnostic indicator 30 is shown mounted under the hood of vehicle 22. The wiring connector 18 is coupled to the receptacle 19. Receptacle 19 is electrically connected (not shown) to the diagnostic indicator 30. As explained below, the diagnostic indicator 30 is electrically coupled to the remainder of the snowplow connection system, and the electrical system of vehicle 22. The diagnostic indicator 30 can be positioned in any convenient location, so long as it is electrically connected in this manner.

The diagnostic indicator 30 serves to indicate the status of the various components of the snowplow 10 and the vehicle 22. The diagnostic indicator 30 is coupled to diagnostic circuitry 50 which monitors the continuity of the various solenoids which control the hydraulic actuators, and the various relays employed. The status of any other electrical or mechanical component used on the snowplow 10 could also be monitored. As shown, the diagnostic indicator 30 has a series of LED's 32 which indicate the status of the designated component. If all components are functioning, main status indicator 34 is illuminated. Obviously, any configuration of indicators is feasible so long as a problem with any particular subsystem (or specific component) is identifiable. The more complex the indicator 30, the more detail it may reveal about the components of the snowplow 10. However, this added complexity also adds to the cost of the unit. The present invention contemplates a range of indicators 30 being available, thus allowing the individual consumer to select the level of detail included in the indicator 30.

In use, an operator may make it a habit to check the diagnostic indicator 30 before each use of the snowplow 10. As a practical matter, this step will usually be skipped especially if diagnostic indicator 30 is not located in plain view of the operator. As such, a general warning indicator is provided within the system. That is, if any of the components indicated are inoperable, diagnostic circuit 50 will cause the external lighting components to indicate this malfunction. For example, if a problem is detected, diagnostic circuit 50 may cause the vehicle's headlights (which are normally off when the snowplow 10 is connected) to turn on or flash. It would be difficult for an operator to overlook this indication. Once alerted, the operator can then check the diagnostic indicator 30 to determine what the specific problem is.

As an alternative, the snowplow headlamps 20 could be caused to flash instead of the vehicle headlights 26, as the general warning indicator. This is a less desirable embodiment because the snowplow headlamps 20, which the operator is relying on, will not be functioning normally. As such, if the problem detected is one that the operator cannot remedy himself, the vehicle and plow may need to be brought in for servicing. This would force the operator to drive the vehicle without the aid of the plow headlights, which is obviously hazardous at certain times and under certain conditions.

One added benefit of the diagnostic indicator 30 controlling both the snowplow headlamps 20 and the vehicle headlights 26 is the added control that is imparted. That is, in those systems where the vehicle's headlights 26 are normally disabled during use of the plow 10, the diagnostic indicator 30 could have an added control which allows the operator to override this function. This would allow the operator to selectively turn on the vehicle headlights 26, thus providing illumination while working between the plow 10 and the vehicle 22.

In another embodiment, diagnostic indicator 30 could be selectively coupled to the snowplow 10 when the snowplow 10 is not coupled to a vehicle. The diagnostic indicator 30 would either have to have a self-contained power supply, or be coupled to an external power source. In either case, the diagnostic circuitry 50 could determine whether the components of the snowplow 10 were functional prior to the snowplow 10 being coupled to a vehicle. For example, prior to connecting the snowplow 10 to the vehicle 22, the operator would connect diagnostic indicator 30 to the snowplow 10, most likely via the wire connector 18. In this embodiment, the diagnostic circuitry 50 would be mounted within the housing of the indicator 30 along with a battery to provide power. The diagnostic circuitry would sense the functionality of the various components of the snowplow and alert the operator to their status. In this manner, the operator would know not to utilize the plow 10 until the problem was corrected.

Figure 3:
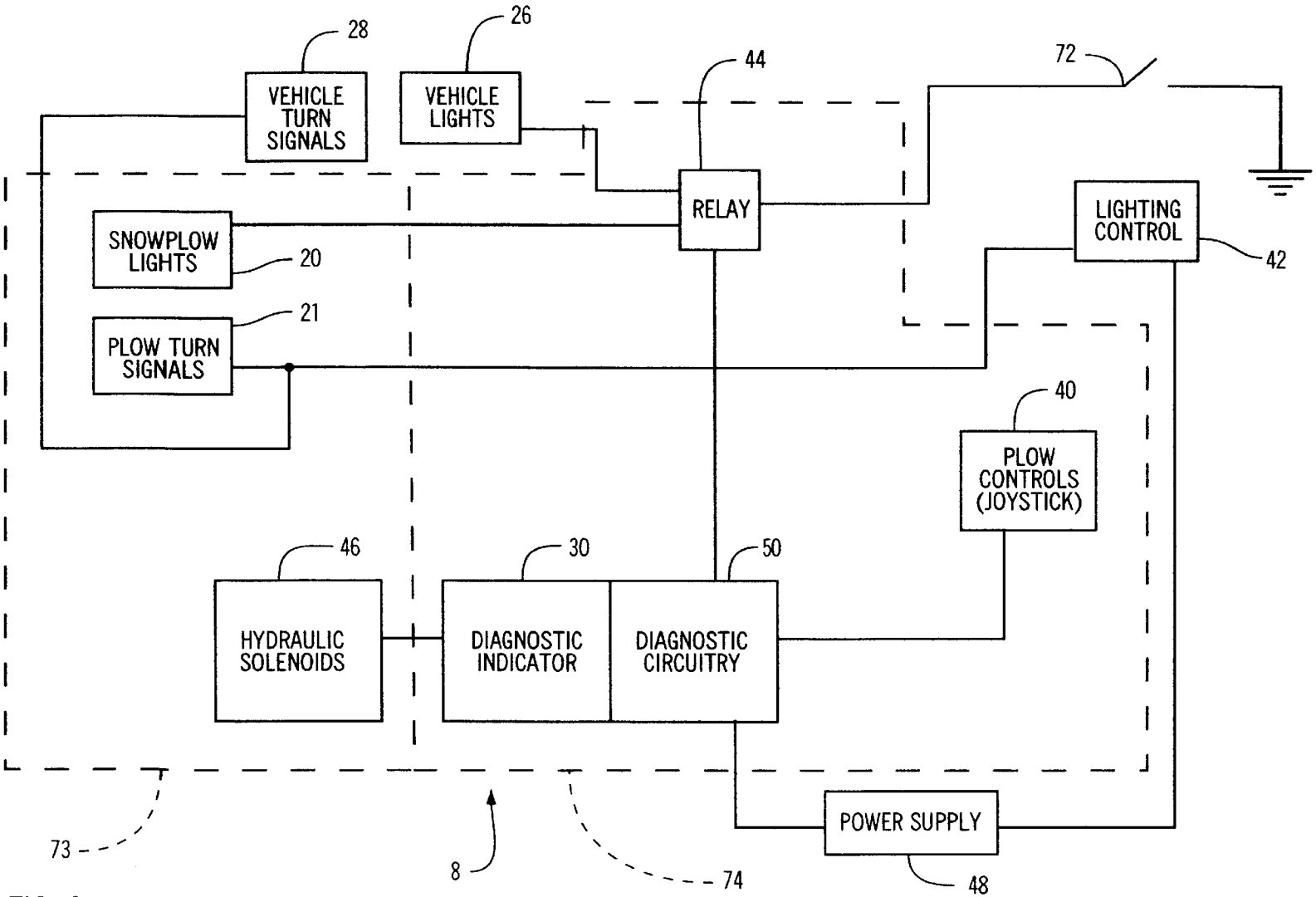
FIG. 3 is a block diagram of the snowplow system.

FIG. 3 is a block diagram of the diagnostic elements integrated with a vehicle's electrical system. In this embodiment, the diagnostic and control system 8 is only set to monitor the functionality of the solenoid coils 46. As is standard in most vehicles, the headlights 26 and turn signals 28 are connected to a set of lighting controls 42 located within the cab of the vehicle. Current is delivered from power supply 48 to the lighting controls 42 and then selectively to the headlights 26 and turn signals 28. As such, the operator can turn the various lights on and off as well as selecting between a high and low beam for the headlights 26.

The diagnostic control system 8 (designated by the dashed line) represents the electrical components of the snowplow connection system 5. The external components 73 are those components of the plow which are coupled to the vehicle but remain outside of it, such as the plow lights 20, 21, and the solenoids 46. External components 73 will be affixed to the frame of the plow 10. Internal components 74 are those elements of the diagnostic control system 8 which are mounted within the vehicle itself. Relay 44 is coupled between the lighting controls 42, the vehicle lights 26, and the plow lights 20. The relay 44 will toggle between delivering power to the vehicle's lights 26 or the plow's lights 20. The lighting controls 42 will then control either the vehicle headlights 44 or the plow headlights 20, depending upon the position of the relay 44.

The relay 44 is controlled by diagnostic circuitry 50 which monitors the hydraulic solenoids 46. Relay 44 is configured so that the vehicle headlights 26 will receive power when the lighting controls 42 are on, unless the relay 44 is energized. This is a safety feature which prevents the relay 44 from interfering with the headlights 26 when the snowplow 10 is not connected. Furthermore, override switch 72 is coupled to the relay 44 and is located within the cab of the vehicle. Override switch 72 opens the relay's 44 connection to ground, thus causing the vehicle headlights 26 to be selectively turned on.

Diagnostic circuitry 50 monitors the hydraulic solenoids 46 by evaluating the continuity of the various coils. The status of each solenoid 46 is then displayed by diagnostic indicator 30. As mentioned above, when the snowplow 10 is not connected to vehicle 22, relay 44 passes power to the vehicle headlights 26. Once the snowplow 10 has been connected, diagnostic circuitry 50 continuously monitors the solenoids 46. Assuming all of the solenoids 46 are found to be continuous, diagnostic circuitry 50 toggles the relay 44 so that power flows to the snowplow headlights 26, but not the vehicle headlights 26. Concurrently, this status is indicated by the diagnostic indicator 30. If one or more of the solenoids 46 is found to be discontinuous, then diagnostic circuitry 50 causes relay 44 to close the connection to the vehicle lights 26, causing them to turn on (and causing the plow lights to turn off). Diagnostic indicator 30 will show that there is a problem and indicate which solenoid(s) is responsible. In this embodiment, the general warning indicator is simply the turning on of the vehicle headlights 26 (and turning off of the plow lights). As such, the system requires that the lighting controls 42 be in the on position for the general warning to work. The diagnostic indicator will display the status of the solenoids 46 regardless of the state of the various headlights.

Plow controls 40 are located within the cab of the vehicle and allow the operator to control the movement of the snowplow 10. In this embodiment, plow control 40 is a joystick. By actuating the joystick, the corresponding solenoid 46 is engaged, causing a hydraulic actuator 16 to move the blade 12 in the proper direction.

Figure 4:
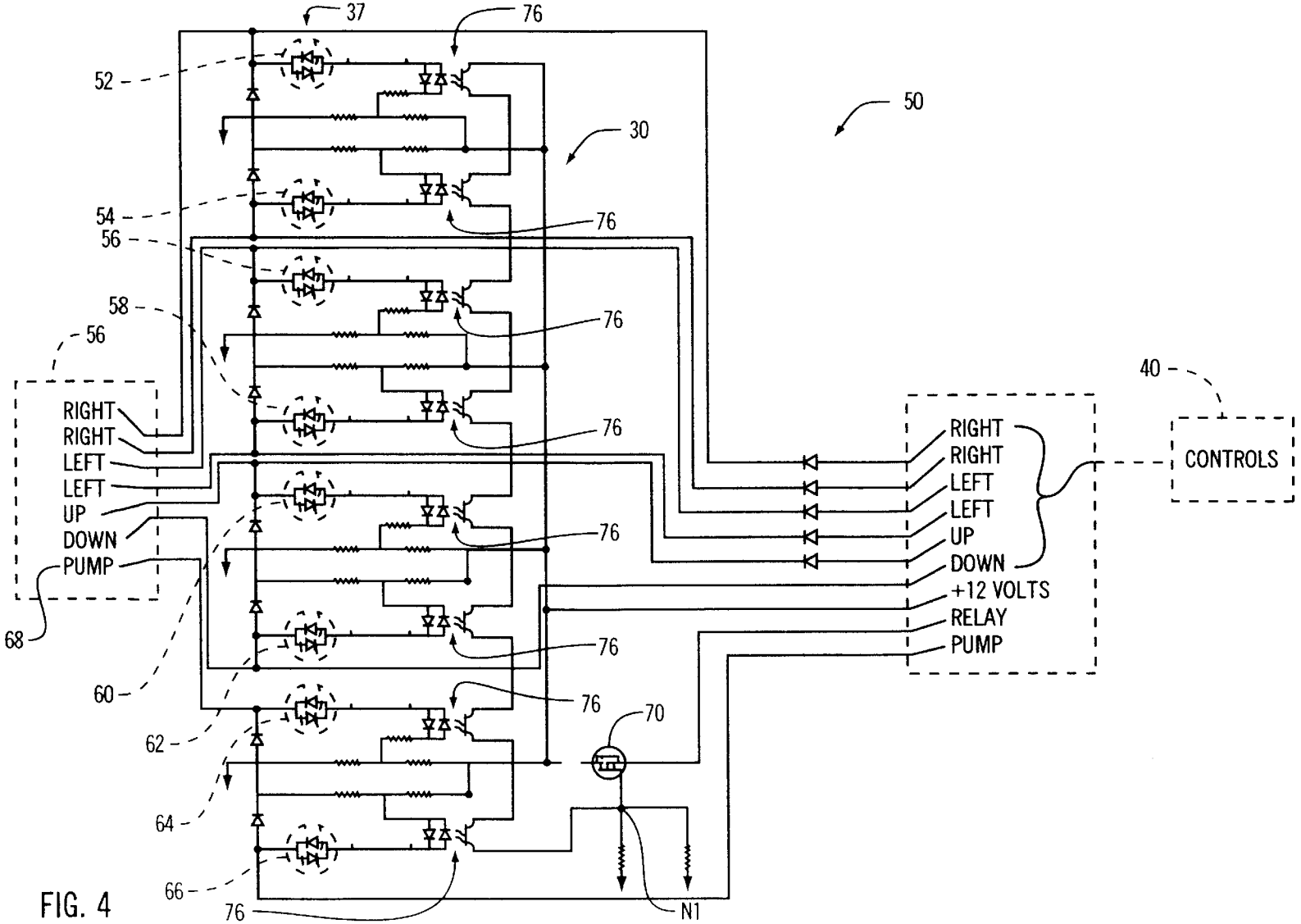
FIG. 4 is a circuit diagram of a diagnostic circuit and indicator.

FIG. 4 illustrates a circuit which includes both the diagnostic indicator 30 and the diagnostic circuitry 50. As is shown, the snowplow controls 40 are coupled to their corresponding solenoids 46 through diagnostic control circuit 50. For each direction of movement, two solenoids 46 are provided (to extend and retract the hydraulic actuators 16). As such, a separate LED 32 is provided for each solenoid and these LED's form diagnostic indicator 30. Specifically, the following LED's are provided: right in 52, right out 54, left in 56, left out 58, up 60, down 62. Additionally, LED 64 is provided to show the continuity of the pump coil 68. The pump coil 68 is coupled to a pump/motor (not shown) which provides the motive force for the hydraulic actuators 16. LED 66 is coupled with and will indicate the status of the relay 44.

A plurality of phototransistors 76 are coupled in series as shown, so that each LED is operatively coupled to a single phototransistor 76. In operation power is delivered to the circuit either by the actuation of a particular plow control or by the connection to +12 volts. In either case, when all of the solenoids 46 are continuous, all of the phototransistors 76 are caused to turn on. This allows current to flow from the +12 volt connection through all of the phototransistors 76 to the node Ni. Node Ni is coupled to MOSFET 70 which serves to control the relay 44. Therefore, when MOSFET 70 receives current via node Ni, it causes relay 44 to toggle to the snowplow lighting position. If any solenoid is discontinuous, the associated phototransistor 76 will not turn on. Therefore, power cannot flow through the chain of phototransistors 76 and MOSFET 70 toggles relay 44 to the vehicle headlight position.

Figure 5:
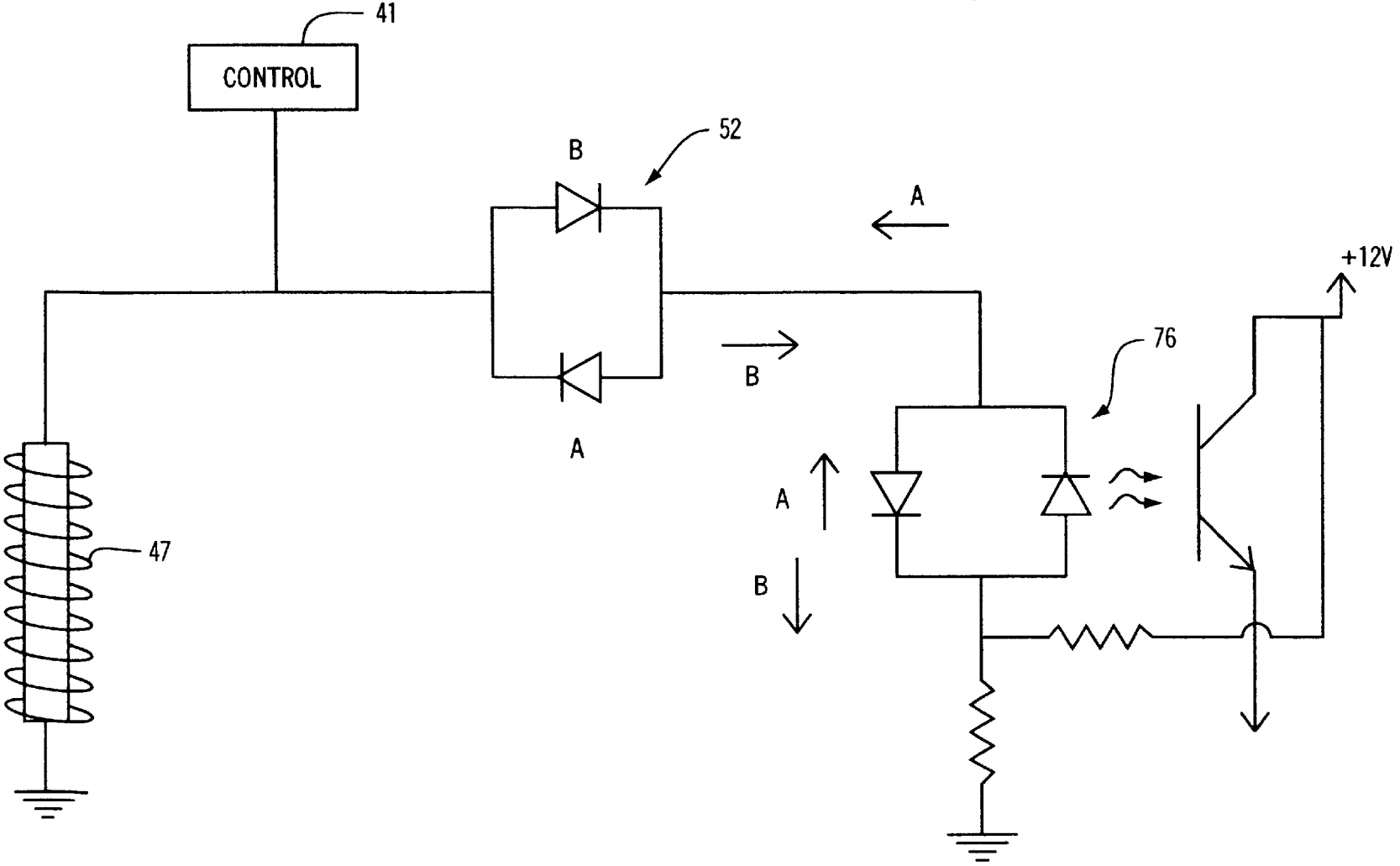
FIG. 5 is a circuit diagram of one LED of the diagnostic circuit elements.

FIG. 5 is a circuit diagram showing LED 52, along with the "right in" control 41 and the "right in" solenoid 47. There are three relevant states which this circuit can be in. The first is the solenoid is continuous and the control is not being actuated. The second is that the solenoid is continuous and the control is being actuated. The third is that the solenoid is discontinuous. In the first case, current flows from the +12 volt source, up through phototransistor 76 in the "A" direction, through bi-colored LED 52 causing the "A" LED to emit, and then to ground through the solenoid 47. Therefore, when illuminated, the "A" LED indicates a continuous solenoid 47.

In the second situation, control 41 is actuated causing current to flow from the control 41 through the solenoid 47 to ground. Also, current flows through LED "B" (in the B direction), through phototransistor 76 and to ground. In both the first and second case, phototransistor 76 is caused to turn on allowing current to flow through the chain of phototransistors 76 (shown in FIG. 4), which in turn ultimately controls the relay 44. The illumination of LED "B" indicates a continues solenoid that is in use.

In the third case, solenoid 47 is discontinuous. Current from the +12 volt source cannot pass through the phototransistor 76 because there is no connection to ground. Therefore, phototransistor 76 will not turn on. Thus, MOSFET 70 will not receive power via node Ni and the relay 44 will be caused to engage the vehicle headlights 26. In this situation, neither LED "A" or "B" is illuminated, thus indicating the problem. When solenoid 47 is discontinuous, control 41 could still be actuated causing current to flow through LED 52 and phototransistor 76 (as described in the second case). This will serve to toggle between the snowplow headlights 20 and vehicle headlights 26, but the corresponding movement will obviously not occur with the snowplow.

The above described embodiment is one of only many which may be employed. For example, as shown relay 44 simply toggles between the snowplow headlights 20 and vehicle headlights 26, causing one or the other to be illuminated if the lighting controls 42 are turned on. Instead, the relay 44 could be configured so that the snowplow headlights 20 remain on when the vehicle headlights 26 are turned on to indicate a problem. This would allow the vehicle to be driven at night, even with a problem. Alternatively, the vehicle headlights could be caused to flash rather than simply remaining on (either with or without the snowplow headlights being on). Similarly, the snowplow headlights could be caused to flash to indicate the problem. Finally, the relay could be arranged so that the general warning indicator (whatever variation described above) is caused to occur whether or not the lighting controls 42 are in the "on" position. For example, during daylight operation a snowplow operator may not have turned his headlights on. If an error is detected with the previous embodiments, no general warning indication will be given unless the headlights are turned on. As such, the problem may simply go undetected unless the operator happens to check the diagnostic indicator 30. In this embodiment, when an error is detected the relay 44 is toggled and delivers power to the vehicle's headlights 26 regardless of the position of the lighting controls 42.

As shown, only the solenoids 46 and relay 44 are monitored by the diagnostic circuit 50. However, virtually any of the components of the snowplow 10 could be monitored. For example, referring to FIG. 4, the various filaments of the lighting elements could be monitored for continuity in the same way as is shown for the solenoids 46. Both the vehicle and snowplow headlamps and turn signals could be so monitored. A separate LED 32 (and the circuit shown in FIG. 5) would be added for each filament that was to be monitored. Alternatively, the lights could be grouped into various subsystems, to reduce the complexity of the detector. That is, rather than indicating the status of each bulb, the diagnostic indicator 30 could simply alert the operator that there was a problem with the plow turn signals. It would then be up to the operator to determine which bulb was malfunctioning.

As shown, diagnostic indicator 30 will not illuminate the LED 32 representing a component when an error is detected. This could be modified so that if discontinuity or any other problem is detected, the diagnostic indicator will illuminate a representative LED positively identifying the problem.

Those skilled in the art will further appreciate that the present invention may be embodied in other specific forms without departing from the spirit or central attributes thereof. In that the foregoing description of the present invention discloses only exemplary embodiments thereof, it is to be understood that other variations are contemplated as being within the scope of the present invention. Accordingly, the present invention is not limited in the particular embodiments which have been described in detail therein. Rather, reference should be made to the appended claims as indicative of the scope and content of the present invention.

What is claimed is:

1. A detection system for a snowplow that is coupleable to a vehicle, comprising.

a control system, the control system located within the vehicle and controlling a plurality of components on the snowplow;

a diagnostic circuit, the diagnostic circuit being coupled between the control system and the snowplow so that the diagnostic circuit detects a condition of the snowplow components; and an indicator, the indicator being coupled to the diagnostic circuit and indicating the condition of at least one of the snowplow components; and a relay, the relay coupled between the diagnostic circuit and a lighting system of the vehicle so that the diagnostic circuit can selectively enable and disable the lighting system.

2. The detection system of claim 1 wherein the diagnostic circuit also monitors a status of the control system and the indicator indicates that status.

3. The detection system of claim 1 wherein the indicator further includes a plurality of LED's.

4. The detection system of claim 1 wherein the diagnostic circuit causes the lighting system to flash when certain conditions are detected within the snowplow.

5. The detection system of claim 1 wherein the diagnostic circuit detects the condition of the components by detecting continuity through each component.

6. The detection system of claim 5, wherein the diagnostic circuit detects the continuity of at least one solenoid used for controlling a hydraulic actuator and at least one lighting element.

7. The detection system of claim 6 wherein the indicator specifically identifies each solenoid detected.

8. The detection system of claim 6 wherein the indicator specifically identifies each lighting element detected.

9. The detection system of claim 5 wherein the diagnostic circuit detects the continuity of a relay and the indicator indicates the condition of the relay.

10. A snowplow system for attachment to a vehicle comprising:

a snowplow, the snowplow including;

a blade;

a mounting bracket connected to the blade and coupleable to the vehicle;

a plurality of hydraulic actuators, the hydraulic actuators selectively causing the blade to move relative to the mounting bracket;

a plurality of solenoids, the solenoids coupled to and controlling the plurality of hydraulic actuators;

a snowplow lighting system for providing illumination and directional indication;

a wire harness coupleable to the vehicle;

a control system, the control system located within the vehicle and controlling the solenoids and the snowplow lighting system;

a relay, the relay coupled between a power supply and a vehicle lighting system;

a diagnostic circuit, the diagnostic circuit being coupled between the vehicle and the snowplow so as to detect the status of the solenoids and the snowplow lighting system; and an indicator, the indicator coupled to the diagnostic circuit and indicating the status of the hydraulic actuators and the lighting system.

11. The snowplow system of claim 10 wherein the status is indicated by selectively illuminating one or more LED's.

12. The snowplow system of claim 11 wherein the status is further indicated by causing the relay to actuate the vehicle lighting system.

13. The snowplow system of claim 12 wherein the actuation of the vehicle lighting system includes causing the vehicle lighting system to flash.

14. The snowplow system of claim 10 wherein the status is detected by determining the continuity of the solenoids and the lighting system.

15. The snowplow system of claim 10 wherein the indicator identifies and indicates the status of each solenoid and each bulb in the lighting system.

16. A detection system for a snowplow that is coupleable to a vehicle, comprising.

a control system, the control system located within the vehicle and controlling a plurality of components on the snowplow;

a diagnostic circuit, the diagnostic circuit being coupled between the control system and the snowplow so that the diagnostic circuit detects a condition of the snowplow components; and an indicator, the indicator being coupled to the diagnostic circuit and indicating the condition of at least one of the snowplow components, wherein the diagnostic circuit detects the condition of the components by detecting continuity through each component including at least one solenoid used for controlling a hydraulic actuator and at least one lighting element.

17. The detection system of claim 16 wherein the diagnostic circuit also monitors a status of the control system and the indicator indicates that status.

18. The detection system of claim 16 wherein the indicator further includes a plurality of LEDs.

19. The detection system of claim 16 further including:

a relay, the relay coupled between the diagnostic circuit and a lighting system of the vehicle so that the diagnostic circuit can selectively enable and disable the lighting system.

20. The detection system of claim 16 wherein the diagnostic circuit causes the lighting system to flash when certain conditions are detected within the snowplow.

21. The detection system of claim 16 wherein the indicator specifically identifies each solenoid detected.

22. The detection system of claim 16 wherein the indicator specifically identifies each lighting element detected.

23. The detection system of claim 16 wherein the diagnostic circuit detects the continuity of a relay and the indicator indicates the condition of the relay.

* * * * *

UNITED STATES PATENT AND TRADEMARK OFFICE

CERTIFICATE OF CORRECTION

PATENT NO. : 6,154,122
DATED : November 28, 2000
INVENTOR(S) : Peter C. Menze

It is certified that error appears in the above-identified patent and that said Letters Patent is hereby corrected as shown below:

Column 6,
Line 50, after the word "node" delete "Ni" and insert -- N1 --.
Line 50, after the word "Node" delete "Ni" and insert -- N1 --.
Line 55, after the word "node" delete "Ni" and insert -- N1 --.

Column 7,
Line 20, after the word "node" delete "Ni" and insert --N1 --.

Signed and Sealed this

Second Day of October, 2001

*Attest:*

Nicholas P. Godici

NICHOLAS P. GODICI
*Acting Director of the United States Patent and Trademark Office*

*Attesting Officer*